US009187946B2

(12) United States Patent
Krause

(10) Patent No.: US 9,187,946 B2
(45) Date of Patent: Nov. 17, 2015

(54) THROUGH-WALL METAL FLASHING HAVING THERMAL BREAKS

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 0 days.

(21) Appl. No.: 14/483,568

(22) Filed: Sep. 11, 2014

(65) Prior Publication Data

US 2015/0152678 A1 Jun. 4, 2015

Related U.S. Application Data

(60) Provisional application No. 61/876,724, filed on Sep. 11, 2013.

(51) Int. Cl.

| | |
|---|---|
| ***E06B 1/62*** | (2006.01) |
| ***E04B 1/66*** | (2006.01) |
| *E04B 1/76* | (2006.01) |

(52) U.S. Cl.

CPC . *E06B 1/62* (2013.01); *E04B 1/665* (2013.01); *E04B 2001/7679* (2013.01); *E06B 2001/628* (2013.01)

(58) Field of Classification Search

CPC ..... E06B 2001/628; E06B 1/62; E06B 1/644
See application file for complete search history.

(56) References Cited

U.S. PATENT DOCUMENTS

| | | | | | |
|---|---|---|---|---|---|
| 1,976,166 | A * | 10/1934 | Fricdberg | 52/302.6 |
| 2,024,524 | A * | 12/1935 | Jones | 52/412 |
| 5,819,478 | A * | 10/1998 | Bayes | 52/62 |
| 6,023,892 | A * | 2/2000 | Sourlis | 52/169.5 |
| 6,584,746 | B1 * | 7/2003 | Hohmann et al. | 52/513 |
| 6,945,000 | B1 * | 9/2005 | Hohmann et al. | 52/513 |
| 8,621,802 | B2 * | 1/2014 | Spyrou | 52/378 |
| 8,826,620 | B2 * | 9/2014 | Krause | 52/506.08 |
| 8,833,025 | B2 * | 9/2014 | Krause | 52/506.08 |
| 8,893,440 | B2 * | 11/2014 | Wetmore | 52/62 |
| 2003/0177708 | A1 * | 9/2003 | Gatherum | 52/58 |
| 2003/0177709 | A1 * | 9/2003 | Gatherum | 52/58 |
| 2003/0177727 | A1 * | 9/2003 | Gatherum | 52/302.6 |
| 2005/0028455 | A1 * | 2/2005 | Koch et al. | 52/58 |
| 2008/0141597 | A1 * | 6/2008 | O'Rourke et al. | 52/62 |
| 2010/0205869 | A1 * | 8/2010 | Pangburn et al. | 52/60 |
| 2012/0017527 | A1 * | 1/2012 | Koch et al. | 52/302.1 |
| 2012/0167505 | A1 * | 7/2012 | Krause | 52/302.1 |
| 2012/0233947 | A1 * | 9/2012 | Koch et al. | 52/302.1 |
| 2012/0255250 | A1 * | 10/2012 | Wetmore | 52/302.6 |
| 2013/0152498 | A1 * | 6/2013 | Krause | 52/235 |
| 2014/0250811 | A1 * | 9/2014 | Krause | 52/309.4 |
| 2015/0121787 | A1 * | 5/2015 | Krause | 52/302.1 |

* cited by examiner

*Primary Examiner* — Rodney Mintz

(74) *Attorney, Agent, or Firm* — The Watson I.P. Group, PLC; Jovan N. Jovanovic; Vladan M. Vasiljevic

(57) ABSTRACT

A through-wall flashing device includes a metal exterior surrounding a polymeric core, wherein the metal exterior is substantially non-continuous or otherwise interrupted by thermal breaks disposed about the metal exterior. In assembly, the thermal breaks help to reduce or all together eliminate thermal bridging from an exterior of a building construction to the interior of a building or building wall. The through-wall flashing device is adapted for use with a variety of wall constructions and is specifically configured to provide insulation and moisture sheeting properties around doors, windows and other architectural apertures which may be found in a wall construction.

21 Claims, 4 Drawing Sheets

THROUGH-WALL METAL FLASHING HAVING THERMAL BREAKS

FIELD OF THE INVENTION

The present invention generally relates to a through-wall flashing system for a building, and more specifically, to a through-wall metal flashing system that provides one or more thermal breaks between the exterior and interior conditions of a wall construction of the building.

BACKGROUND OF THE INVENTION

Through-wall flashing systems generally comprise a membrane used in a wall construction for the purpose of preventing the passage of water into a structure from a joint in the wall. Flashing devices can be used anywhere in a building where it is necessary to deflect water away from seams or joints or other areas where water runoff is concentrated. In the past, flashing devices have been comprised of sheet metal such as lead, aluminum, copper, galvanized steel, stainless steel and other architectural metals. These sheet metal components have been primarily used in flashing constructions due to their strength, workability and durability. However, these metal components, when used to connect exterior components of a building directly to interior frame, are at least partially exposed to external conditions and provide direct paths for thermal conductivity from the exterior of a building to an inside portion of a wall construction, or into the interior of the building itself. Such thermal conductivity is known as thermal bridging. Particularly, these metal substances provide negligible thermal resistance, such that hot and cold temperatures from the external environment are easily transferred through these metallic flashing devices. Thus, a need exists for a through-wall flashing system having flashing members with the structural rigidity of continuous metallic flashing members, while greatly reducing, if not eliminating, thermal bridging from exposed portions of the flashing members to internally disposed portions of the flashing members.

SUMMARY OF THE INVENTION

One aspect of the present invention includes a through-wall flashing system for use at an interface between a wall accessory and an exterior wall construction of a building. The flashing system includes at least one flashing strip having a polymeric core, wherein the polymeric core includes an interior flashing portion, an exterior flashing portion and a body portion extending therebetween. An exterior facing is operably coupled to and substantially surrounds the polymeric core, wherein the exterior facing is comprised of a plurality of adjacent surfaces. Thermal breaks are disposed between one or more of the adjacent surfaces of the exterior facing and are adapted to disrupt thermal communication along the exterior facing between the interior flashing portion and the exterior flashing portion of the flashing strip.

Another aspect of the present invention includes a through-wall flashing system for use in a wall construction. The flashing system includes a flashing member configured to be received within a cavity of the wall construction and includes an external flashing portion disposed along an exterior surface of the wall construction, an internal flashing portion disposed within the cavity of the wall construction, and a web portion extending between the internal and external flashing portions. The flashing member further includes a polymeric core having an upper surface and a lower surface with an exterior facing operably coupled to the upper and lower surfaces. A plurality of thermal breaks are disposed along the exterior facing, thereby separating or dividing the exterior facing into adjacent portions. The thermal breaks are adapted to thermally insulate adjacent portions of the exterior facing from one another, thereby reducing temperature transmission between flashing portions.

Yet another aspect of the present invention includes a through-wall flashing system for use in a wall construction. The flashing system includes a flashing strip having an interior flashing portion, an exterior flashing portion and a body portion extending between the interior flashing portion and the exterior flashing portion. The flashing strip further includes an exterior facing operably coupled to and substantially surrounding a polymeric core. Thermal breaks are disposed along a length of the exterior facing, and are adapted to disrupt thermal temperature transmission between interior and exterior surfaces of the wall construction.

DETAILED DESCRIPTION OF THE PREFERRED EMBODIMENTS

Figure 1:
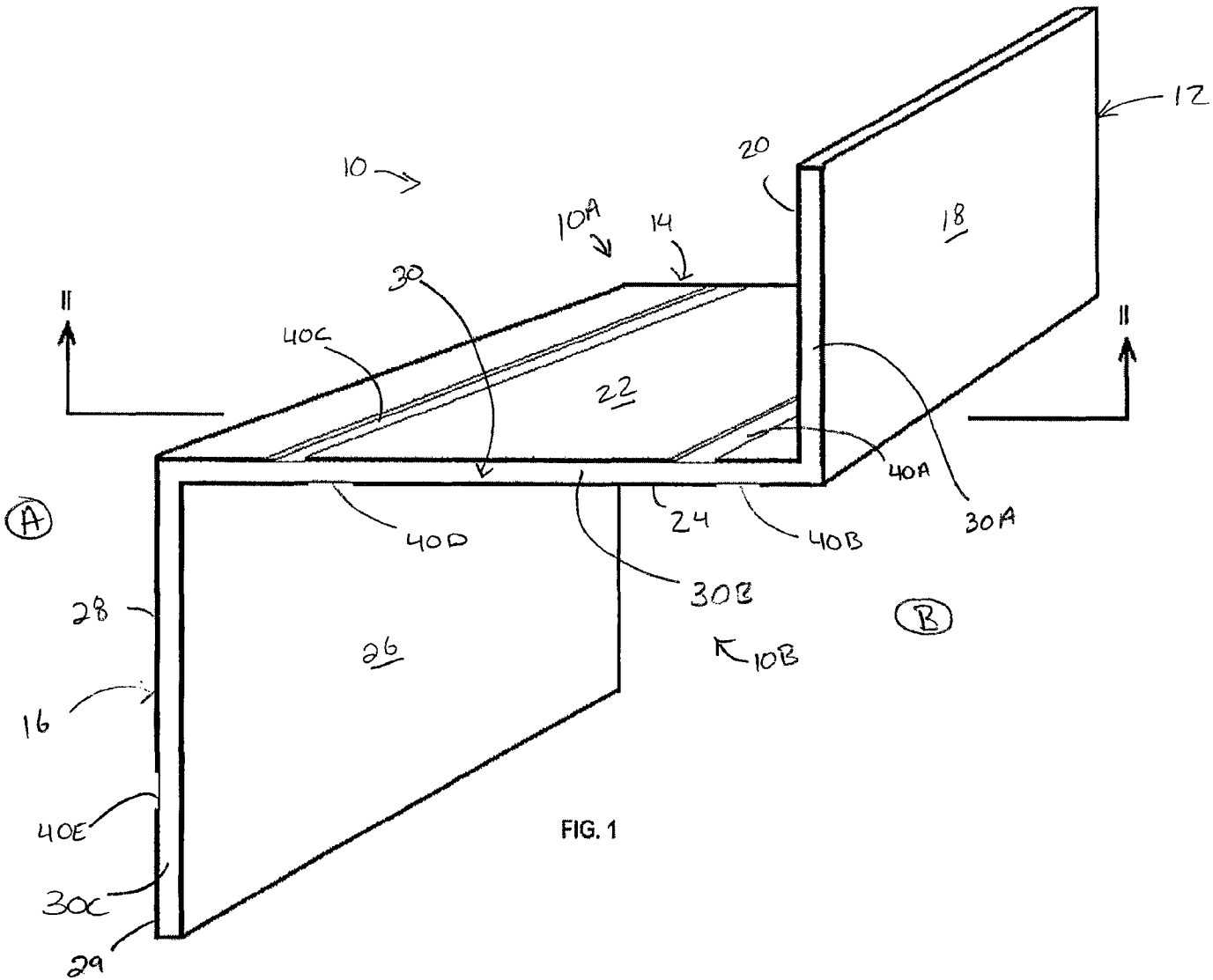
FIG. 1 is a perspective view of a flashing device according to one embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, the reference numeral 10 generally designates a flashing member or strip according to one embodiment of the present invention. The flashing member 10 is adapted for use in a flashing system. As shown in FIG. 1, the flashing strip 10 includes a plurality of panel portions with a first panel 12, a second panel 14 and a third panel 16. The first and third panels 12, 16 are generally vertical panels attached to one another by intermediate second panel 14 which, in this embodiment, is substantially horizontal. It is contemplated that in assembly the intermediate panel 14 may have a downward cant from the first panel 12 towards the third panel 16, thereby providing a gravitational drain for any moisture that comes into contact with the flashings strip 10. As shown in FIG. 1, the flashing strip 10 has an overall stepped configuration, however, other configurations are contemplated for use with the present invention. The first panel 12 defines an interior or internal flashing portion and includes an inner surface 18 and an outer surface 20. Panel 14 defines a web or body portion and includes an upper surface 22 and a lower surface 24. The third panel 16 defines an exterior or external flashing portion and includes an inner surface 26 and outer surfaces 28 and 29. In assembly, the exterior surfaces or skins 20, 22, 28 and 29 are potentially exposed to environmental conditions A on an exterior side 10A of the flashing strip 10. Interior surfaces or skins 18, 24, 26 are disposed on an interior side 10B of the flashing strip 10, and are generally adjacent to the building construction materials which are subject to interior conditions B. Together, the inner and outer surfaces 18, 20, 22, 24, 26, 28 and 29 of the panels 12, 14 and 16 define an exterior facing 32 for the flashing strip 10 which is an exterior shell having thermal breaks as further described below.

Collectively, the exterior surfaces or skins of the flashing strip 10 are generally comprised of sheet metal made from lead, aluminum, copper, galvanized steel, stainless steel, zinc alloy or lead coated copper. Other sheet metal substrates are also contemplated for use with the present invention. The metal surfaces provide the malleability, strength and durability necessary to prolong the life of the flashing strip 10. However, in known flashing devices, a continuous or uninterrupted flashing made from a sheet metal material is known to cause thermal bridging from outside environmental conditions to the interior or wall construction of a building. To counter these thermal bridging effects, the flashing strip 10 of the present invention includes thermal breaks disposed on the panel portions 12, 14 and 16 of the flashing strip 10.

Figure 2:
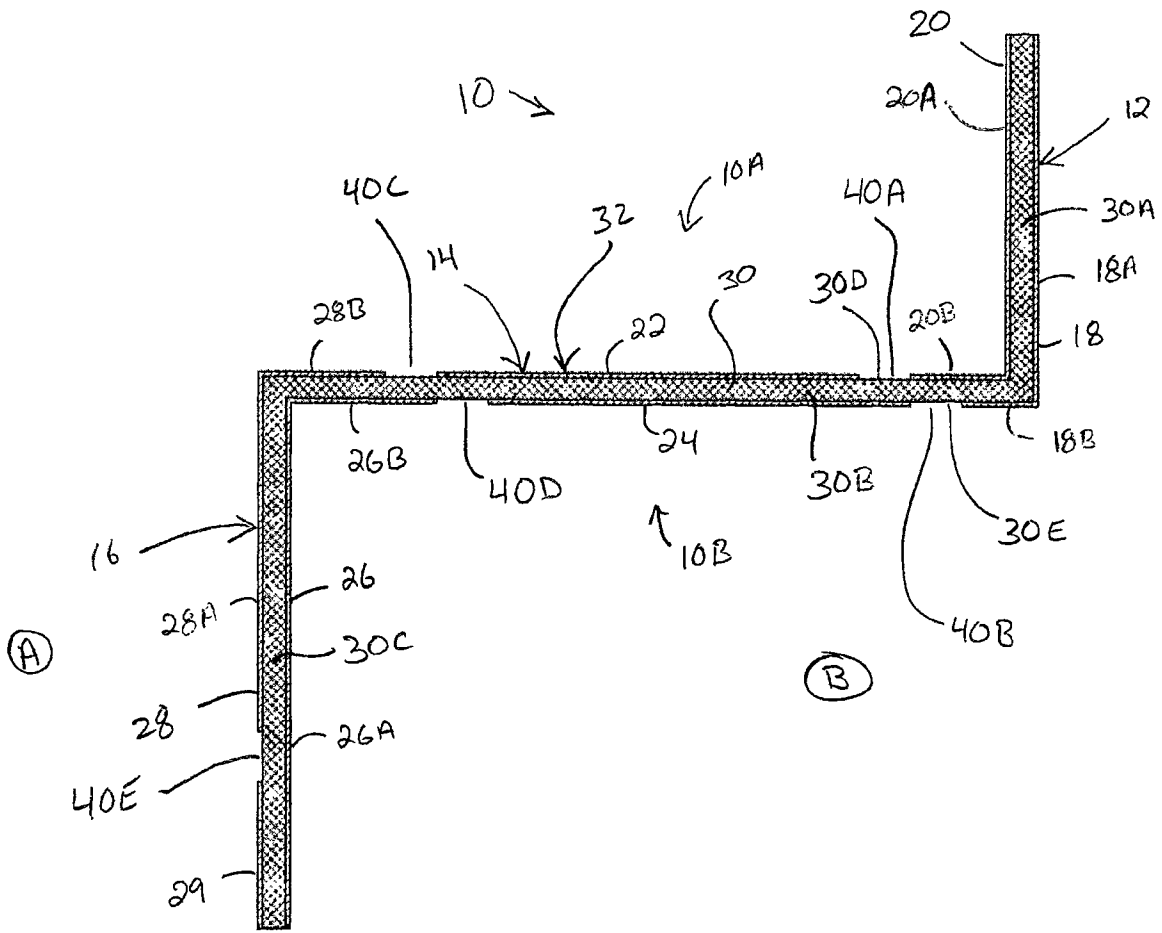
FIG. 2 is a cross-sectional view of the flashing device of FIG. 1 taken at line II.

Referring now to FIGS. 1 and 2, the flashing strip 10 is shown having a polymeric core 30 disposed within the exterior facing 32 defined by interior and exterior surfaces 18, 20, 22, 24, 26, 28 and 29 of the panels 12, 14 and 16. In the embodiment shown in FIGS. 1 and 2, interior panel portion 12 is a generally upright panel portion and includes interior metal surface 18 and exterior metal surface 20 having a polymeric core portion 30A disposed there between. Similarly, generally horizontal or downwardly sloping web or body panel portion 14 includes a polymeric core portion 30B disposed between interior metal surface 24 and exterior metal surface 22. Finally, in the embodiment shown in FIGS. 1 and 2, downwardly facing exterior panel portion 16 includes polymeric core portion 30C disposed between interior metal surface 26 and exterior metal surface 28. The polymeric core 30 is generally comprised of an anticorrosive polymeric material that exhibits high insulative qualities or rather, demonstrates high R-value properties such as an R-value in the range of about R.2 to about R8 per inch. Polymeric materials suitable for the polymeric core of the present invention include thermoplastics or thermoset resin materials including for example: acrylonitrile-butadiene-styrene (ABS) copolymers, vinylesters epoxies, phenolic resins, polyvinyl chlorides (PVC), polyesters, polyurethanes, polyphenylsufone resin, polyarylsulfones, polyphthalimide, polyamides, aliphatic polyketones, acrylics, polyxylenes, polypropylenes, polycarbonates, polyphthalamides, polystyrenes, polyphenylsulfones, polyethersulfones, polyfluorocarbons, bio-resins and blends thereof. Other such thermoplastics and thermoplastic resins suitable for the present invention are known in the art which demonstrate high R-values and are thereby heat resistant as well as anticorrosive. Thermoplastics of the present invention are also contemplated to incorporate a recyclable polymer or are made of a polymeric material which is partially comprised of a renewable resource such as vegetable oil or the like. Further, microspheres, such as polymeric or glass nanospheres, can be added to the makeup of the polymeric core 30 to provide further insulative properties and increased R-value expression. When necessary, the polymeric core 30 can also be reinforced or doped with a reinforcing fiber such as fiber glass, carbon fibers, cellulose fibers, aramid fibers, and other such reinforcing agent to provide added structural rigidity to the flashing strip 10.

In assembly, the polymeric core 30 forms a thermal break between exterior metal surfaces or skins, such as surfaces 20, 22 and 28 shown in FIGS. 1 and 2, and interior metal surfaces or skins, such as surfaces 18, 24, and 26 shown in FIGS. 1 and 2. Metal surfaces 18, 24, and 26 are commonly in thermal communication with building substrates or wall constructions in assembly, as these surfaces are often disposed directly adjacent to the building substrate in which they are used. In other known flashing systems, this contact between metal surfaces and building substrates creates a thermal path or thermal gradient of least resistance that allows heat (or cold) to enter or escape, thereby creating vulnerability in a wall construction for cold spots and moisture problems. In the present invention, the sandwiched position of the polymeric core 30 between interior and exterior metal surfaces (18, 24, 26 and 20, 22, 28) ensures that heat (or cold) is not transferred to the building substrate in an effort to control the temperature within a building structure. Thus, the polymeric core 30 reduces or altogether eliminates thermal conductivity from the exterior metal surfaces 20, 22 and 28 to a building substrate in assembly.

The flashing strip 10, as shown in FIGS. 1 and 2, of the present invention also combats thermal bridging by incorporating thermal breaks in the exterior facing 32 of the flashing strip 10. For example, in the embodiment shown in FIG. 2, the flashing strip 10 includes exterior metal surface 20 which, in this embodiment, is an L-shaped surface having a generally upright portion 20A and a generally planar portion 20B. The portions 20A and 20B of metal surface 20 are operably coupled to an upper surface 30D of the polymeric core 30 along core portions 30A and 30B respectively. The metal surfaces of the exterior facing 32 of the flashing strip 10 are generally affixed to the polymeric core at inner and outer core surfaces 30A, 30B by continuous bonding. Interior metal surface 18 is also an L-shaped metal surface which includes upright portion 18A and horizontal portion 18B which is operably coupled to inner surface 30E of the polymeric core 30. Exterior metal surface 22 is a generally planar metal surface that is operably coupled to the outer surface 30D of the polymeric core 30 and is spaced apart from portion 20B of exterior metal surface 20 by a gap or spacing 40A, thereby defining a thermal break 40A therebetween. Similarly, interior metal surface 24 is operably coupled to inner surface 30E of the polymeric core 30 and is spaced apart from portion 18B of interior metal surface 18 at a spacing or gap 40B disposed on the underside 10B of the flashing strip 10. Thermal breaks 40C and 40D are also found on panel portion 14 on exterior and interior sides 10A and 10B of the flashing strip 10 as shown in FIG. 2. Thermal break 40C is disposed in a spacing between planar portion 28B of metal surface 28 and metal surface 22. In the embodiment shown in FIG. 2, exterior metal surface 28 includes an upright portion 28A and a planar portion 28B, while interior metal surface 26, disposed on an opposing side of polymeric core portion 30C relative to exterior metal surface 28, includes a generally upright portion 26A and a generally planar portion 26B. Thermal break 40D is disposed in a spacing between planar portion 26B and metal surface 24. As further shown in FIG. 2, a thermal break 40E is defined in a spacing between upright portion 28A of exterior metal surface 28 and metal surface 29 disposed on panel portion 16 of the flashing strip 10.

Having thermal breaks 40A-40E disposed along the interior surface 10B and exterior surface 10A of the flashing strip 10 provides for a break-up in thermal communication between surfaces in contact with a building substrate and interior environment B, and surfaces exposed to exterior environmental conditions A. Thus, the present invention provides a polymeric core 30 sandwiched between interior and exterior metal surfaces, and also provides thermal breaks 40A-40F disposed laterally along the length of exterior facing to adequately reduce thermal communication or temperature transmission into and out of a building interior or a cavity within a wall construction. The thermal breaks 40A-40E provide for a substantially non-continuous exterior facing 32 disposed about the majority of the polymeric core 30, wherein the non-continuous exterior facing 32 is made up of the interior and exterior metal surfaces disposed on panel portions 12, 14 and 16. Having thermal breaks 40A-40F, which run the entire length of the flashing strip 10, ensures that thermal bridging does not occur between adjacent metal portions of the exterior facing 32. Thus, thermal breaks 40A-40F serve to isolate and thermally insulate adjacent portions of the exterior facing 32 from one another, thereby reducing temperature transmission between flashing portions 12, 14 and 16 of the flashing strip 10. It will also be understood that, preferably, the thermal breaks on opposing sides of the polymeric core are offset from each other, that is, the thermal break 40A is offset from thermal break 40B so that to provide enhanced rigidity to the flashing. As such, a portion of the metal surface opposes the thermal break 40B on the other side of the polymeric core. The same is true of the remaining thermal breaks. Additionally, it is preferred that the thermal breaks are spaced apart from the corners or edges where the panel portions meet.

The configuration and dimensions of the panel portions 12, 14 and 16 of flashing strip 10 can be determined by the architectural requirements of the flashing needs for a particular building substrate or wall construction. A typical thermal gap, such as thermal gaps 40A-40E shown in FIGS. 1 and 2, may comprise a substantially uniform channel along the length of the flashing strip, and, may be approximately 0.25 mm, but can also be adjusted for architectural specifications. In the embodiment shown in FIGS. 1 and 2, it is contemplated that the polymeric core 30 may be dimensioned to have a thickness in a range of about 3 mm to 6 mm to adequately provide interruption of a thermal gradient. The flashing system of the present invention is a customizable flashing system, wherein a plurality of flashing strips or members, such as flashing strip 10 described above, are customized to surround or encase a wall accessory in a wall construction, such as a window, vent, chimney or other like structure. As used throughout this disclosure, panel portions, such as panel portions 12, 14 and 16 described above, are flashing portions of a flashing member, wherein an exterior shell, such as exterior shell 32, provides thermal breaks between the flashing portions. The thermal breaks are suitable to interrupt temperature transmission between adjacent flashing portions, thereby limiting unwanted temperature changes into and out of a building.

Figure 3:
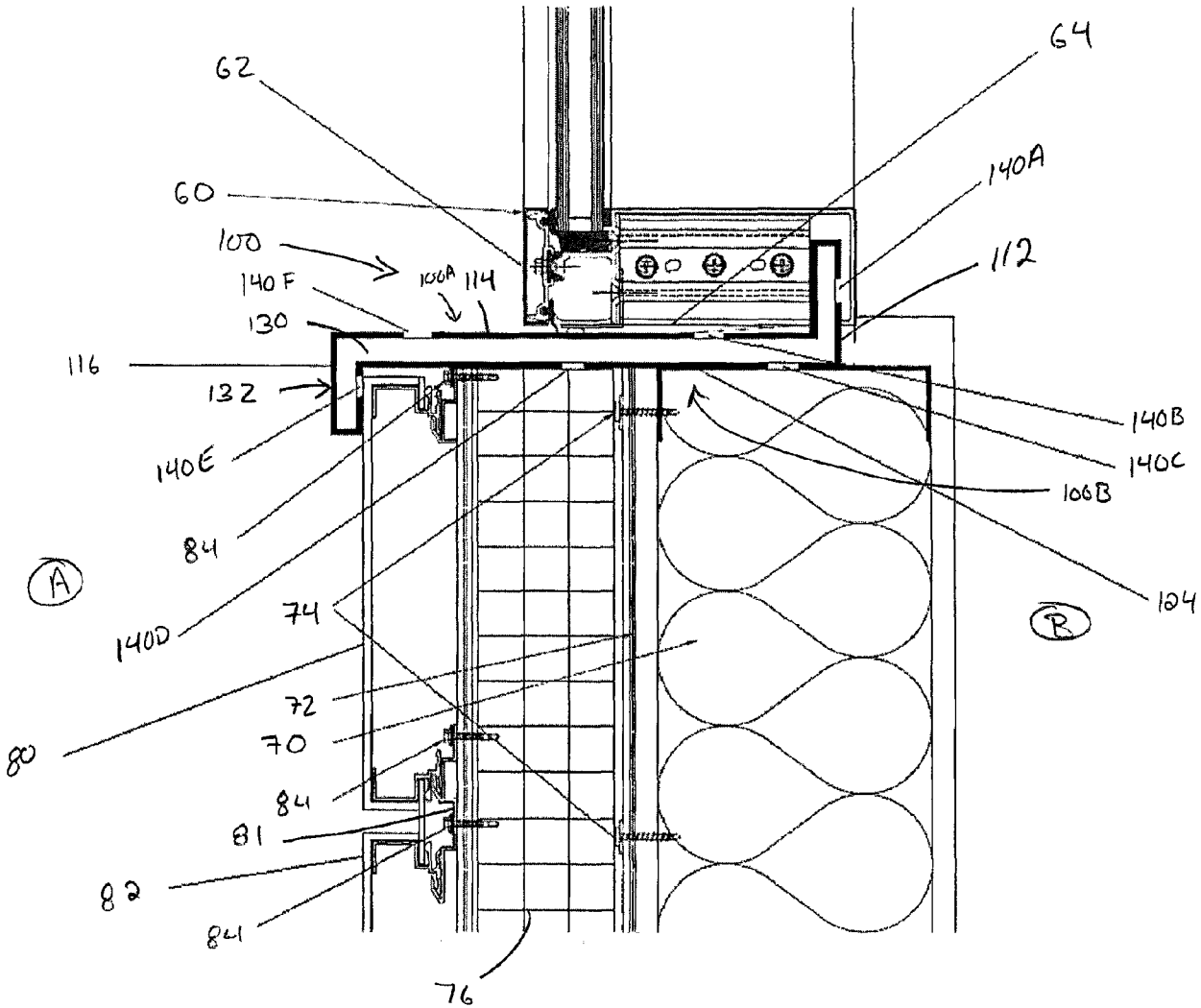
FIG. 3 is a fragmentary cross-sectional view of a flashing device according to another embodiment of the present invention shown in an environmental view in a wall construction.

Referring now to FIG. 3, a standard window sill detail is shown having a flashing strip 100 according to another embodiment of the present invention. The flashing strip 100 includes panel portions 112, 114 and 116 which are similar in configuration to panel portions 12, 14 and 16 as described above with reference to flashing strip 10. The flashing strip 100 includes an upper or outer surface 100A and a lower or inner surface 100B. As shown in FIG. 3, the flashing strip 100 is disposed between a curtain wall system 60 and a metal stud wall construction 70. The curtain wall system 60 includes an outwardly facing exterior wall 62 and a bottom wall 64. In assembly, the bottom wall 64 of the curtain wall system 60 is disposed adjacent the upper side 100A of the flashing strip 100. The metal stud wall construction 70 may be an insulated wall construction which includes a weather barrier or exterior sheeting layer 72 coupled thereto using fasteners 74. The fasteners 74 are further used to couple a polymeric bracket system 76 to the metal stud wall construction 70. An exterior cladding system includes composite panels 80 and 82 which are coupled to the polymeric bracket system 76 using brackets 81 and fasteners 84. The wall construction 70 and curtain wall system 60 are representative of assemblies that could be used with the present invention, however, they are not meant to limit the scope of the invention and are exemplary only. As shown in FIG. 3, the curtain wall system 60, the flashing strip 100, wall construction 70 and exterior cladding units 80, 82 are all potentially exposed to an exterior environment A and an interior environment B along portions thereof.

The flashing unit 100, as shown in FIG. 3, includes a polymeric core 130 surrounded by an interrupted exterior facing 132. The exterior facing 132 is contemplated to be comprised of a sheet metal material. The exterior facing 132 is considered interrupted, in that the exterior facing 132 includes a plurality of thermal breaks which are identified in FIG. 3 as thermal breaks 140A-140F. Similar to the thermal breaks noted above, thermal breaks 140A-140F are defined by spacings provided along the entirety of the exterior facing 132 of the flashing strip 100, such that thermal communication between adjacent portions of the exterior facing 132 is interrupted and non-continuous.

Figure 3A:
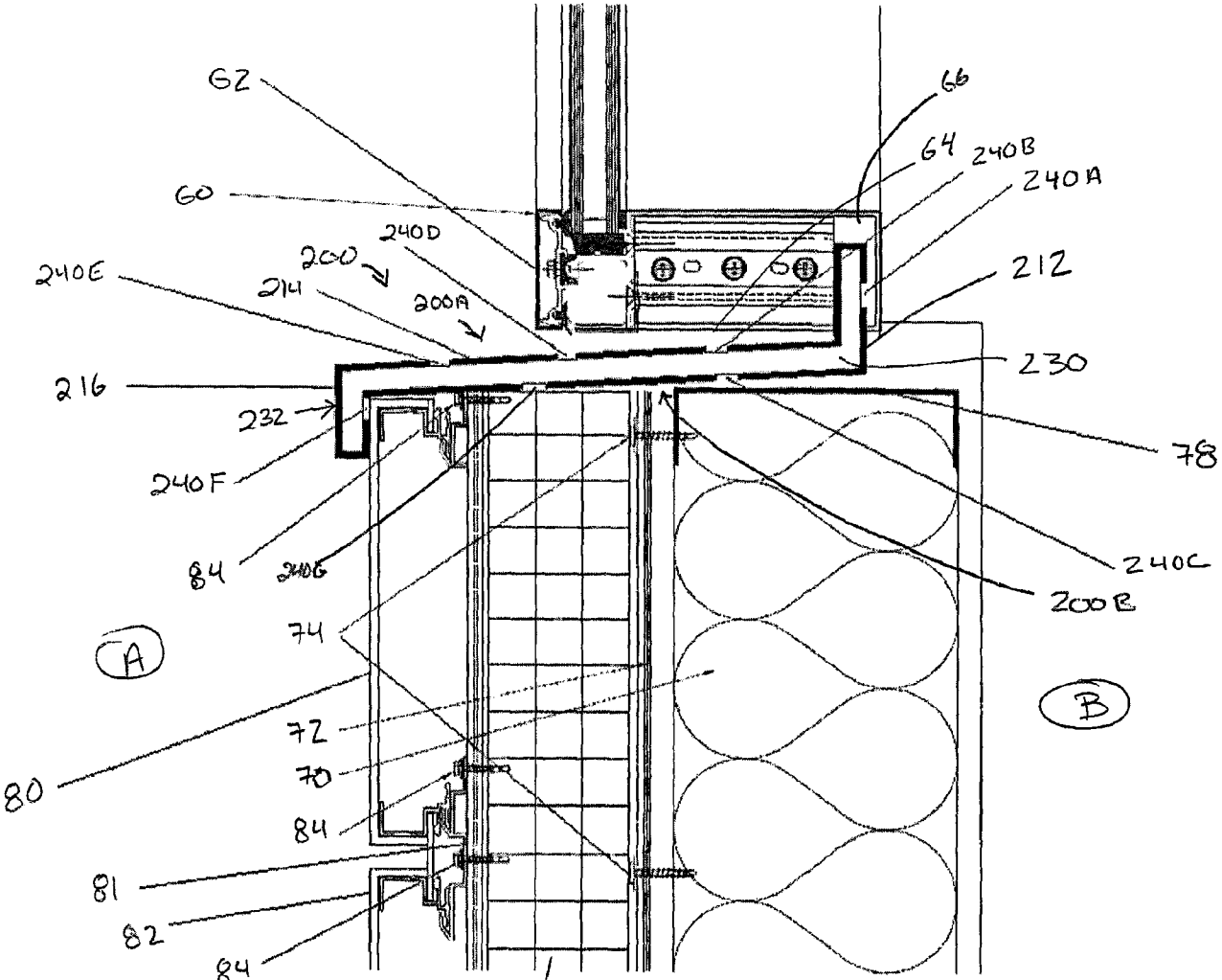
FIG. 3A is a fragmentary cross-sectional view of a flashing device according to another embodiment of the present invention shown in an environmental view in the wall construction of FIG. 3.

Referring now to FIG. 3A, a flashing strip 200 having an upper or outer side 200A in an inner or underside 200B is shown disposed between curtain wall system 62 and wall construction 70. The flashing strip 200 includes panel portions 212, 214 and 216, wherein web panel portion 214 has a downward cant as it extends from panel portion 212 to panel portion 216. In this way, the flashing strip 200 is disposed between a lower surface 64 of the curtain wall system 60 and an upper wall 78 of the wall construction 70. The downward cant of web panel portion 214 helps to gravitationally drain moisture from the wall system in assembly. As shown in FIG. 3A, interior panel portion 212 is disposed within a reglet 66 of the curtain wall system 60, while exterior panel portion 216 is disposed adjacent to outer cladding unit 80. The flashing strip 200 includes a substantially non-continuous exterior facing 232 which is generally comprised of a sheet metal material having thermal breaks 240A-240G disposed therealong. Flashing strip 200 further includes a polymeric core 230 similar to cores 30 and 130 described above. The polymeric core 230, along with the thermal breaks 240A-240G disposed in the exterior facing 232 of the flashing strip 200, helps to insulate the wall construction from environmental conditions disposed on side A of the wall construction that would otherwise thermally bridge to the interior side B, if the exterior facing 232 were in fact continuous and uninterrupted.

The flashing members used in the flashing system of the present invention have a universal attachment design for use with virtually any wall construction or stud wall. For instance, the flashing members of the present invention can be used with structures having concrete masonry units (CMU Walls), composite wall panels, brick walls on CMU or stud walls, terra cotta on stud walls, and on stud wall configurations alone. As noted above, heat travels in the path of least resistance such that heat can invade a wall system and affect an interior atmosphere through relatively finite pathways such as fasteners and the like that have metal to metal contact with exterior conditions. Similarly, exterior exposure to cold temperatures can allow for infusion of cold temperatures into a wall construction along highly thermally conductive components. Most applications of metal flashings retain at least some form of metal to metal contact through metal anchors, fasteners, or sill, transition, and window trim. Fasteners used to couple the flashing members of the present invention to a wall construction do not bridge the thermal breaks of the flashing members and therefore do not thermally bridge the exterior conditions A with the interior conditions B.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A through-wall flashing system comprising:

a polymeric core having a first end and a second end spaced apart from the first end:

a body portion extending between the first end and the second end, the body portion including an upper surface and a lower surface opposite the upper surface, an outer edge and an inner edge;

an interior panel extending between the first end and the second end, and upwardly from the upper surface of the body portion proximate the inner edge, the interior panel having an inner surface and an outer surface;

an exterior panel extending between the first end and the second end, and downwardly from the lower surface of the body portion proximate the outer edge, the exterior panel having an inner surface and an outer surface;

wherein the body portion is positioned and oriented one of oblique and perpendicular to each of the interior panel and the exterior panel;

an exterior facing attached to the polymeric core, the exterior facing comprising a sheet metal member having:

a first skin extending between the first end and the second end, and from the outer surface of the exterior panel over the outer edge and over a portion of the upper surface of the body portion;

a second skin extending between the first end and the second end, and from the upper surface of the body portion over the inner edge and over a portion of the outer surface of the interior panel;

a third skin extending between the inner surface of the exterior panel over the outer edge and over a portion of the lower surface of the body portion;

a fourth skin extending between the lower surface of the body portion, over the inner edge and over a portion of the inner surface of the interior panel;

wherein the first skin and the second skin are spaced apart from each other on the upper surface of the body portion so as to define at least one upper thermal break therebetween extending from the first end to the second end of the polymeric core, thereby exposing the upper surface thereof, and wherein the third skin and the fourth skin are spaced apart from each other on the lower surface of the body portion so as to define at least one lower thermal break therebetween extending from the first end to the second end of the polymeric core, thereby exposing the lower surface thereof.

2. The through-wall flashing system of claim 1 wherein the interior panel and the exterior panel are substantially parallel to each other.

3. The through-wall flashing system of claim 1 wherein the first skin extends over an entirety of the outer surface of the exterior panel.

4. The through-wall flashing system of claim 1 wherein the second skin extends over an entirety of the outer surface of the interior panel.

5. The through-wall flashing system of claim 1 wherein the third skin extends over an entirety of the inner surface of the exterior panel.

6. The through-wall flashing system of claim 1 wherein the fourth skin extends over an entirety of the inner surface of the interior panel.

7. The through-wall flashing system of claim 1 wherein the first skin extends over an entirety of the outer surface of the exterior panel, the second skin extends over the entirety of an outer surface of the interior panel, the third skin extends over an entirety of the inner surface of the exterior panel and the fourth skin extends over an entirety of the inner surface of the interior panel.

8. The through-wall flashing system of claim 1 wherein a front outside thermal break is defined on the outer surface of the exterior panel.

9. The through-wall flashing system of claim 1 wherein a front inside thermal break is defined on the inner surface of the exterior panel.

10. The through-wall flashing system of claim 1 wherein a back outside thermal break is defined on the outer surface of the interior panel.

11. The through-wall flashing system of claim 1 wherein a back inside thermal break is defined on the inner surface of the interior panel.

12. The through-wall flashing system of claim 1 wherein each of the at least one thermal break defined in the upper surface of the body portion are staggered relative to each of the at least one thermal break defined in the lower surface of the body portion.

13. The through-wall flashing system of claim 1 wherein an upper central skin extends between the first skin and the second skin between the first end and the second end and spaced apart from each of the first skin and the second skin to in turn, define a pair of upper thermal breaks between the upper central skin, the first skin and the second skin, to, in turn, expose the upper surface of the body portion of the polymeric core.

14. The through-wall flashing system of claim 13 wherein the upper central skin includes a first upper central skin and a second upper central skin, the first upper central skin and the second upper central skin being spaced apart to define a central upper thermal break spaced apart and between the pair of upper thermal breaks.

15. The through-wall flashing system of claim 13 wherein the pair of thermal breaks are substantially parallel to each other extending from the first end to the second end of the polymeric core.

16. The through-wall flashing system of claim 15 wherein the pair of thermal breaks each have a width, with the width of each of the pair of thermal breaks being substantially identical.

17. The through-wall flashing system of claim 1 wherein a lower central skin extends between the third skin and the fourth skin between the first end and the second end and spaced apart from each of the third skin and the fourth skin to in turn, define a pair of lower thermal breaks between the lower central skin, the third skin and the fourth skin, to, in turn, expose the lower surface of the body portion of the polymeric core.

18. The through-wall flashing system of claim 17 wherein the lower central skin includes a first lower central skin and a second lower central skin, the first lower central skin and the second lower central skin being spaced apart to define a central lower thermal break spaced apart and between the pair of lower thermal breaks.

19. The through-wall flashing system of claim 17, wherein an upper central skin extends between the first skin and the second skin between the first end and the second end and spaced apart from each of the first skin and the second skin to in turn, define a pair of upper thermal breaks between the upper central skin, the first skin and the second skin, to, in turn, expose the upper surface of the body portion of the polymeric core, wherein a lower central skin extends between the third skin and the fourth skin between the first end and the second end and spaced apart from each of the third skin and the fourth skin to in turn, define a pair of lower thermal breaks between the lower central skin, the third skin and the fourth skin, to, in turn, expose the lower surface of the body portion of the polymeric core, and wherein the pair of upper thermal breaks are staggered relative to the pair of lower thermal breaks, so that where an upper portion of the polymeric core is exposed, a corresponding lower portion of the polymeric core opposite the upper portion is covered by one of the third skin, fourth skin and lower central skin, and so that where a lower portion of the polymeric core is exposed, a corresponding upper portion of the polymeric core opposite the lower portion is covered by one of the first skin, the second skin and the upper central skin.

20. The through-wall flashing system of claim 17 wherein the pair of thermal breaks are substantially parallel to each other extending from the first end to the second end of the polymeric core.

21. The through-wall flashing system of claim 20 wherein the pair of thermal breaks each have a width, with the width of each of the pair of thermal breaks being substantially identical.

* * * * *